US010258112B2

(12) United States Patent
Wetzel et al.

(10) Patent No.: US 10,258,112 B2
(45) Date of Patent: Apr. 16, 2019

(54) APPARATUS FOR ATTACHING AN ITEM TO ONE OR MORE SUBSTRATES

(71) Applicant: YKK Corporation, Tokyo (JP)

(72) Inventors: Markus Wetzel, Wuppertal (DE); Rainer Siegemund, Wuppertal (DE)

(73) Assignee: YKK Corporation (JP)

( * ) Notice: Subject to any disclaimer, the term of this patent is extended or adjusted under 35 U.S.C. 154(b) by 123 days.

(21) Appl. No.: 15/293,359

(22) Filed: Oct. 14, 2016

(65) Prior Publication Data

US 2017/0105492 A1 Apr. 20, 2017

(30) Foreign Application Priority Data

Oct. 14, 2015 (DE) ..... 10 2015 013 345

(51) Int. Cl.

| | |
|---|---|
| ***A41H 37/10*** | (2006.01) |
| ***A44B 13/00*** | (2006.01) |
| ***A41H 37/04*** | (2006.01) |
| ***B68G 7/12*** | (2006.01) |
| ***A41H 37/00*** | (2006.01) |
| ***A41H 37/02*** | (2006.01) |

(52) U.S. Cl.

CPC ..... *A44B 13/0076* (2013.01); *A41H 37/001* (2013.01); *A41H 37/005* (2013.01); *A41H 37/02* (2013.01); *A41H 37/04* (2013.01); *A44B 13/0035* (2013.01); *B68G 7/12* (2013.01); *A44B 13/0041* (2013.01)

(58) Field of Classification Search

CPC .... A41H 37/005; A41H 37/04; A41H 37/001; A41H 37/02; A44B 17/0076; A44B 13/0035; A44B 13/0041; B68G 7/12

USPC ..... 29/243.518

See application file for complete search history.

(56) References Cited

U.S. PATENT DOCUMENTS 2,310,007 A * 2/1943 Wolff ..... A41H 37/04 24/692
2,413,702 A * 1/1947 Fenton ..... A41H 37/005 227/15
2,509,434 A * 5/1950 Huelster ..... A44B 17/0076 24/692

(Continued)

FOREIGN PATENT DOCUMENTS

| | | | |
|---|---|---|---|
| JP | S52-4170 | Y2 | 1/1977 |
| WO | 2012-131879 | A1 | 10/2012 |
| WO | 2014-049881 | A1 | 4/2014 |

*Primary Examiner* — David B Jones

(74) *Attorney, Agent, or Firm* — Kilpatrick Townsend & Stockton LLP

(57) ABSTRACT

There is provided an apparatus for attaching an item to a substrate, using a prong ring with a ring and two or more prongs. When attached, the prongs extends from the ring on a first side of the substrate through such substrate and being bent. A lower die is positioned to approach the first side of the substrate. An upper die is on a second side of the substrate. The substrate is placed in a manner substantially perpendicular to the attaching movement of the upper and lower dies and a first redirecting member for redirecting the prongs which are bent inwardly. The first redirecting member cooperates with an abutting member positioned along the approach of the prong ring towards the first side of the substrate for inhibiting movement of the prong ring towards the substrate while the first redirecting member is used.

12 Claims, 12 Drawing Sheets

(56) References Cited

U.S. PATENT DOCUMENTS 2,920,325 A * 1/1960 Janes ..... A41H 37/005
227/15
3,579,773 A * 5/1971 Zysman ..... B68G 7/12
29/440
5,419,035 A * 5/1995 Twigg ..... A41H 37/005
227/15

* cited by examiner

APPARATUS FOR ATTACHING AN ITEM TO ONE OR MORE SUBSTRATES

PRIORITY CLAIM

The present application claims priority to German Patent Application No. 102015013345.4, filed on Oct. 14, 2015 and entitled "Apparatus for Attaching an Item to One or More Substrates," the entire contents of which are hereby incorporated by reference.

TECHNICAL FIELD

The invention relates to an apparatus for attaching an item to one or more substrates, using a prong ring with a ring and two or more prongs.

BACKGROUND

An apparatus of the above kind is known, e.g. from JP S52-4170 Y2. It serves for, e.g., attaching a snap button to a garment. To this end, the prong ring is placed on the first redirecting member, which redirecting member is a pin with a circular cross section and a diameter slightly smaller than the ring of the prong ring so that prongs which are bent inwardly are redirected by positioning the prong ring on the pin and moving it relative to the pin in the axial direction thereof. If the prongs of the prong ring are not straight, i.e. if they do not extend in the direction in which the lower and upper dies approach one another, there is a chance that the prongs do not penetrate the substrate, but are (further) bent and remain on the first side of the substrate instead of being pushed therethrough. This results in a malfunction of the attaching apparatus.

A similar apparatus is known from WO 2012/131879 A1.

WO 2014/049881 A1 discloses an inspection device for inspecting whether or not prongs of prong rings are suitably directed.

In the case of JP S52-4170 Y2 it is difficult to position the prong ring on the pin, particularly if the prongs are bent inwardly. This applies not only if the prong rings are manually positioned on the pin, but also if they are positioned automatically by the attaching apparatus.

SUMMARY

It is, therefore, an object of the present invention to enhance the attaching apparatus known from the prior art resulting in that it is easier to deal with the prong rings, particularly in case that one or more of the prongs is/are bent inwardly.

According to an aspect of the embodiments of the invention, the first redirecting member cooperates with an abutting member positioned along the approach of the prong ring towards the first side of the substrate during attachment for inhibiting movement of the prong ring towards the substrate while the first redirecting member is used.

In other words, the prong ring is not positioned on the redirecting member in the form of a pin or the like, with the potential difficulty in the case where prongs are bent inwardly, but the prong ring is prevented from moving towards the substrate, so that the first redirecting member can be used without any problems resulting from prongs which may be bent inwardly.

According to a preferred embodiment, the first redirecting member is adapted to be moved through the ring of the prong ring to the tip end of at least one of the prongs.

Thereby, prongs which are bent inwardly can easily be redirected, particularly because the prong ring is held against a movement towards the substrate during the movement of the first redirecting member through the ring and to the tip end of at least one of the prongs.

According to a further preferred embodiment, the first redirecting member comprises a pin with a circular cross section. Thereby, it is possible to redirect inwardly bent prongs independently from their circumferential position around the axis of the pin.

Preferably, the abutting member is movable between at least two positions, a first position inhibiting a movement of the prong ring towards the substrate and a second position allowing the movement. Thus, according to this embodiment, the abutting member is used only as long as the first redirecting member is used. When the prongs which were bent inwardly are successfully redirected, the abutting member is retracted in order to not disturb the attaching process.

To this end, the abutting member can be biased into the first position. Thereby, it is only necessary to move the abutting member into the second position, whereas it will automatically return into the first position as soon as released.

Preferably, the abutting member has at least two parts which are movable relative to one another around a pivot point, like a pair of pliers. This is a very simple way of making the abutting member movable between the first and second positions.

According to a further preferred embodiment, the attaching apparatus not only comprises the first redirecting member, but also a second redirecting member, the redirecting member serving for redirecting prongs which are bent outwardly away from the center of the ring, and lying in the path of outwardly bent prongs when approaching the substrate.

Thereby, the prong or prongs of the prong ring is/are straightened whether being bent inwardly or outwardly prior to their use, resulting in an optimum preparation for attachment by being moved through the substrate or substrates.

Preferably, the second redirecting member comprises at least one surface sloped relative to the path of the prongs. When the prong ring is moved along the path, the tip of a prong being bent outwardly abuts against the sloped surface and the prong is redirected by bending inwardly. It is also possible that there is provided a surface that is curved or has a radius.

Preferably, in the case of one sloped surface, the sloped surface is a conical ring surface, and in the case of two or more sloped surfaces, the two or more sloped surfaces together make up a conical ring surface. Thereby, a prong being bent outwardly is reliably redirected by the second redirecting member independently of its circumferential position circumscribing the moving direction along the path.

The slope angle is preferably in the range of 10° to 60°, more preferably 20° to 50° and most preferably 30° to 40°. The angles have proved to reliably redirect prongs which are bent outwardly.

Finally, it is preferred that at least part of the second redirecting member is movable in a direction transverse to the path of the prong, but biased in the inward direction of the prongs. This is advantageous for the function of the second redirecting member, particularly if prongs exert different resistances against the redirecting action during their movement in the inward direction.

BRIEF DESCRIPTION OF THE DRAWINGS

The invention is described in more detail hereinafter with reference to the accompanying drawings showing preferred embodiments of the invention. In the drawings, FIG. 1 schematically shows an apparatus for attaching an item to a substrate, FIGS. 2 to 9 schematically show an embodiment of the invention in different operation positions, FIG. 10 schematically shows a part of the apparatus shown in FIGS. 2 to 9, FIG. 11 schematically shows another part of the apparatus according to FIGS. 2 to 9, and FIG. 12 schematically shows the same as FIG. 6, but of another embodiment.

DETAILED DESCRIPTION

Figure 1:
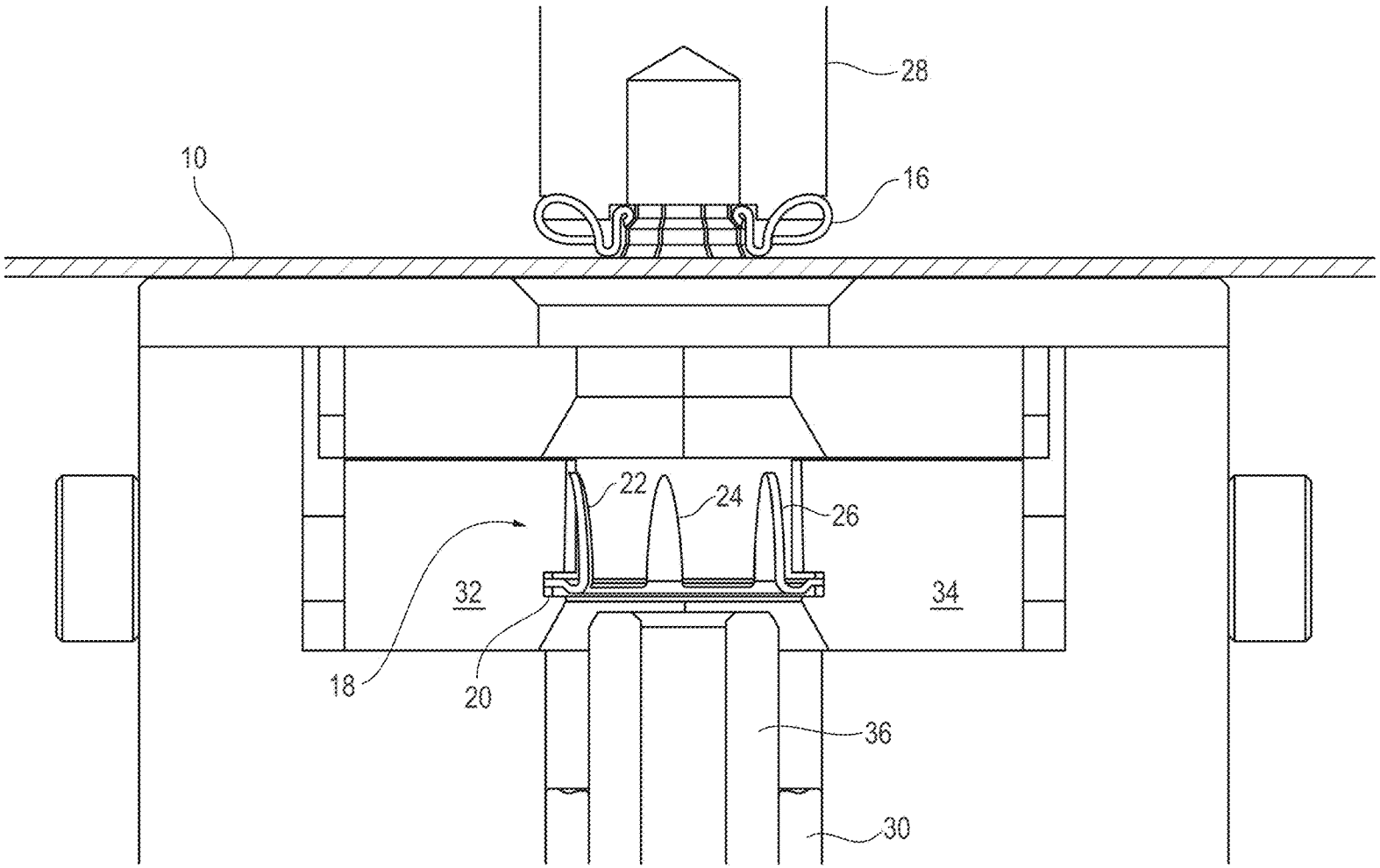

FIG. 1 shows a substrate 10 in the form of a garment which is held by holders (not shown). A part 16 of a snap button is to be attached to substrate 10. To this end, a prong ring 18 with a ring 20 and prongs is used. The prong ring 18 has two or more prongs. In this embodiment, the prong ring has numerous prongs, three of them being numbered 22, 24, 26.

The attaching apparatus shown in FIG. 1 comprises an upper die 28 and a lower die 30. The lower die 30 is positioned to approach the lower side of the substrate 10. The upper die is on the upper side of the substrate 10. As shown in FIG. 1, the substrate 10 is placed in a manner substantially perpendicular to the attaching movement of the upper and lower dies 28 and 30.

The attaching process is as follows: Starting from the positions shown in FIG. 1, lower die 30 is raised so that prongs 22, 24 and 26 of prong ring 18 are pushed through substrate 10 and into part 16 of the snap button and then bent by lowering upper die 28 in order to fix part 16 to substrate 10.

Figure 2:
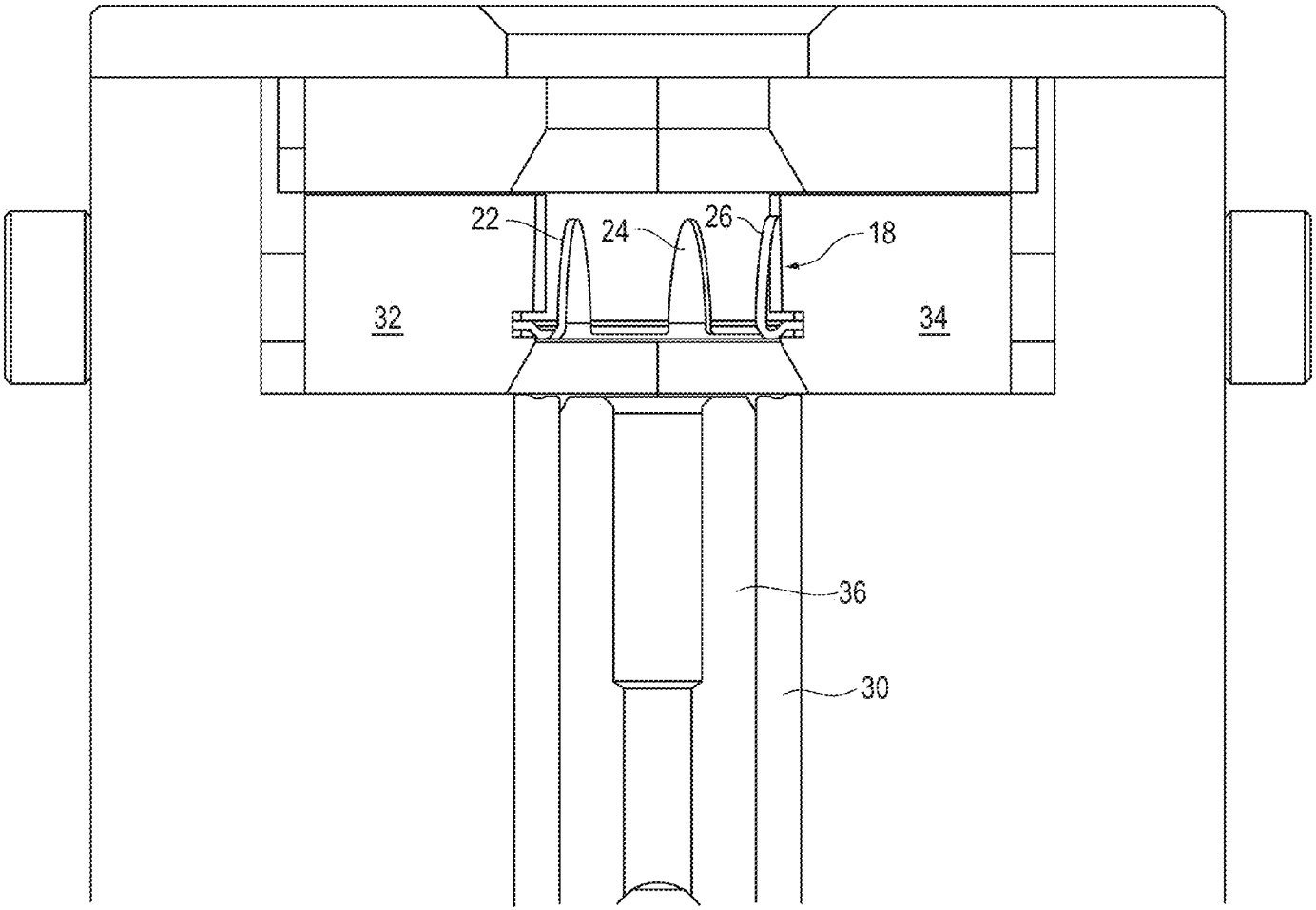

Turning now to FIGS. 2 to 9, the operation of the attaching apparatus according to the depicted embodiment of the invention is explained:

FIG. 2 shows an initial position with prong ring 18 inserted in the apparatus. Particularly, prong ring 18 is held by abutting members 32, 34 which will be explained later. In the initial position depicted in FIG. 2, prongs 22, 24 and 26 might not be in a suitable position for the desired attachment of part 16 (FIG. 1). Rather, prongs 22, 24 and 26 might be bent inwardly or outwardly, what could result in one or more malfunctions.

Figure 3:
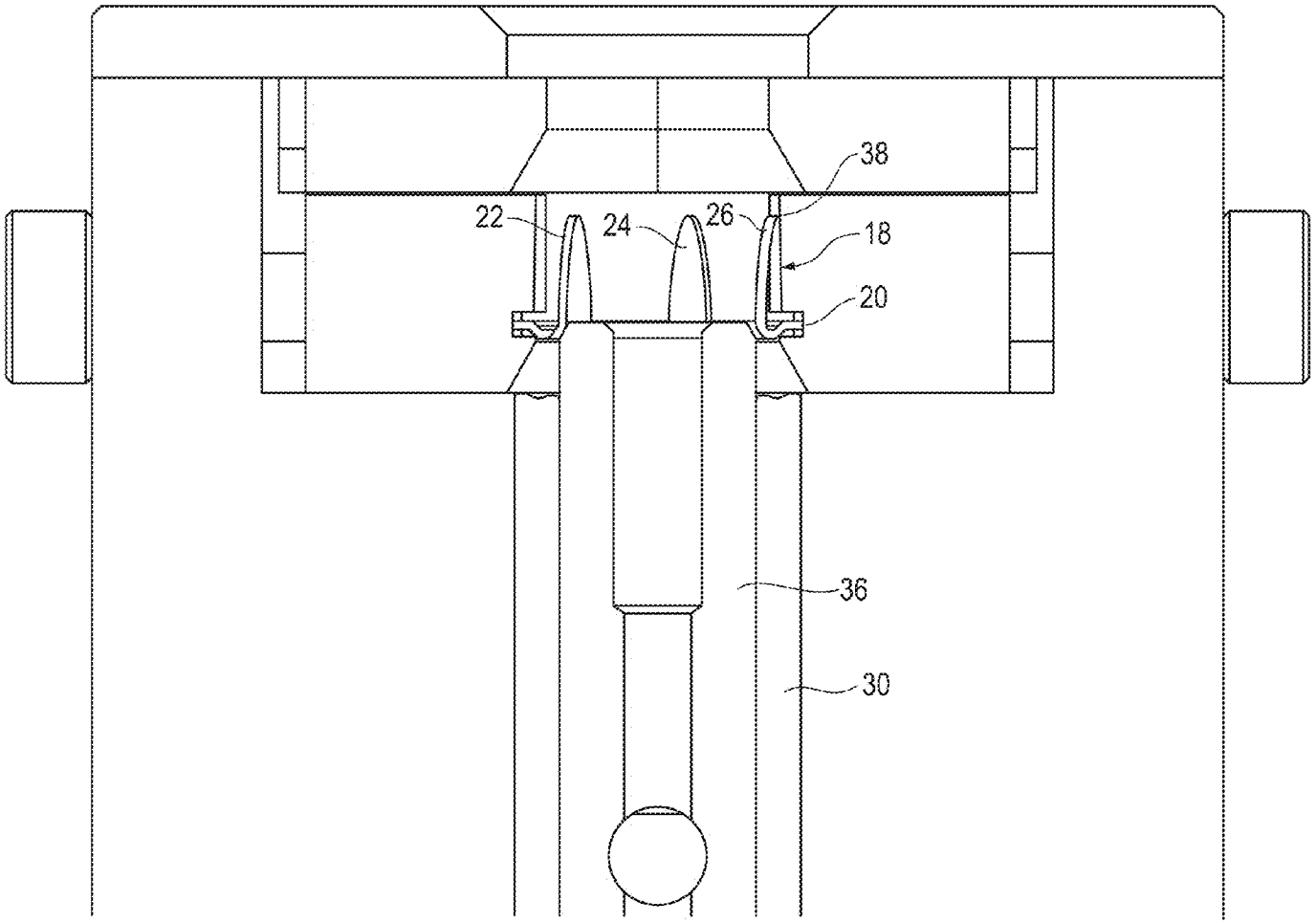

In a first operational step, as is to be taken from FIG. 3, pin 36 is raised into ring 20 of prong ring 18. Thereafter, according to FIG. 4, pin 36 is further raised so it is moved through ring 20 so that the top of pin 36 becomes level with tip end 38 of prong 26 and of course to the tip end of the other prongs 22,24 as well.

Figure 4:
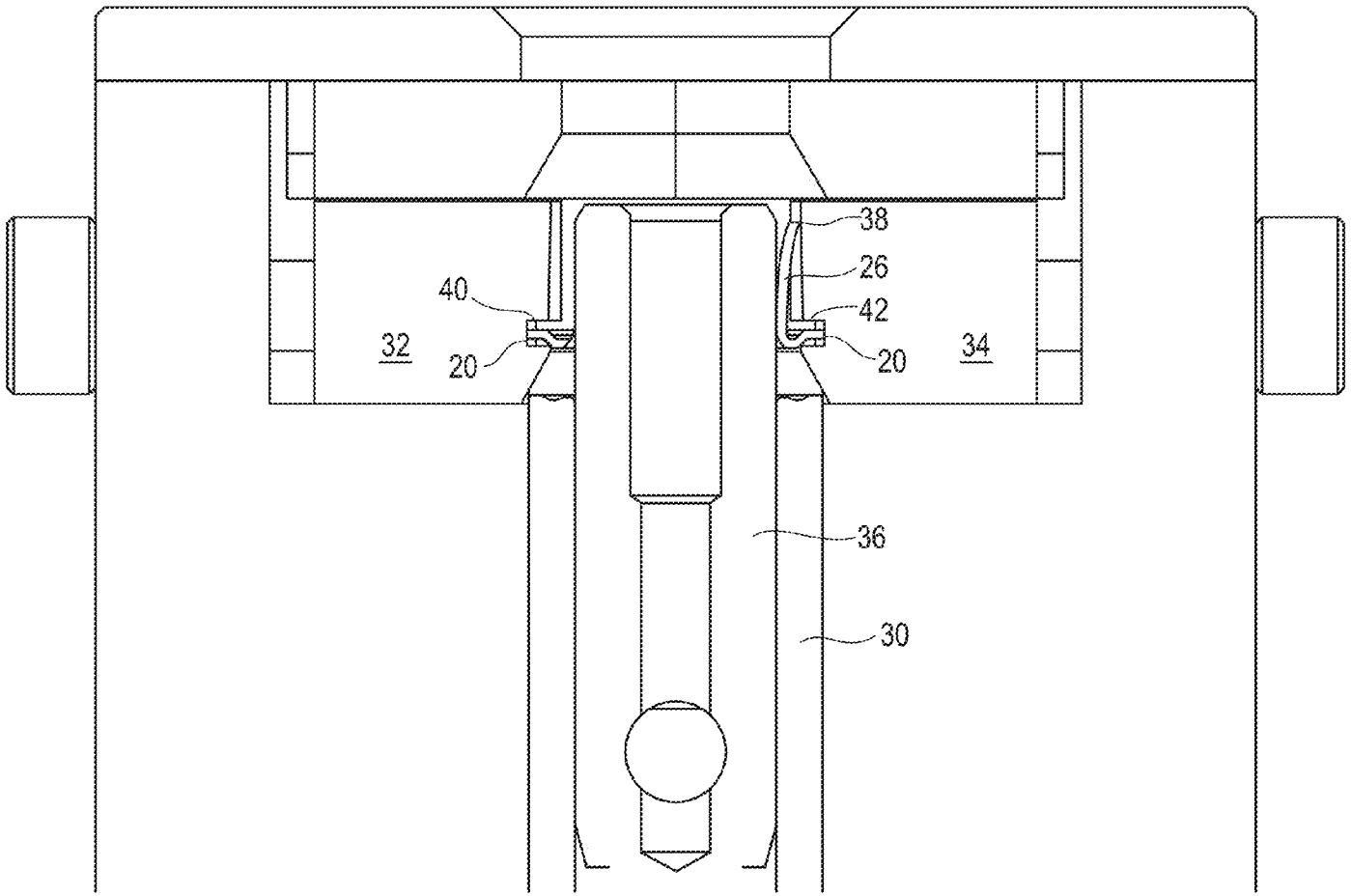

As shown in FIG. 4, pin 36 is raised even further, i.e. beyond tip end 38 of pin 26. Since pin 36 has a circular cross section in compliance with ring 20 and a diameter slightly smaller than ring 20, it is guaranteed that each and every one of the prongs which might have been initially bent inwardly, is redirected by being bent in an outward direction away from the centre of the ring 20 of prong ring 18 to restore the prong to a position substantially parallel to the direction of movement of the pin 36. Thus, pin 36 serves as a redirecting member redirecting prongs which are bent inwardly towards the center of ring 20.

During the raising movement of pin 36 through ring 20 and beyond tip end 38 of prong 26, prong ring 18 must not be carried by this movement because otherwise no redirecting would occur. Therefore, abutting members 32, 34 are positioned along the approach of the prong ring 18 towards the lower side of the substrate 10 for serving to block an upward movement of prong ring 18 during the use of pin 36, i.e. during the redirecting process. To this end, abutting members 32, 34 comprise grooves 40, 42 for receiving ring 20 during the redirecting process.

Figure 5:
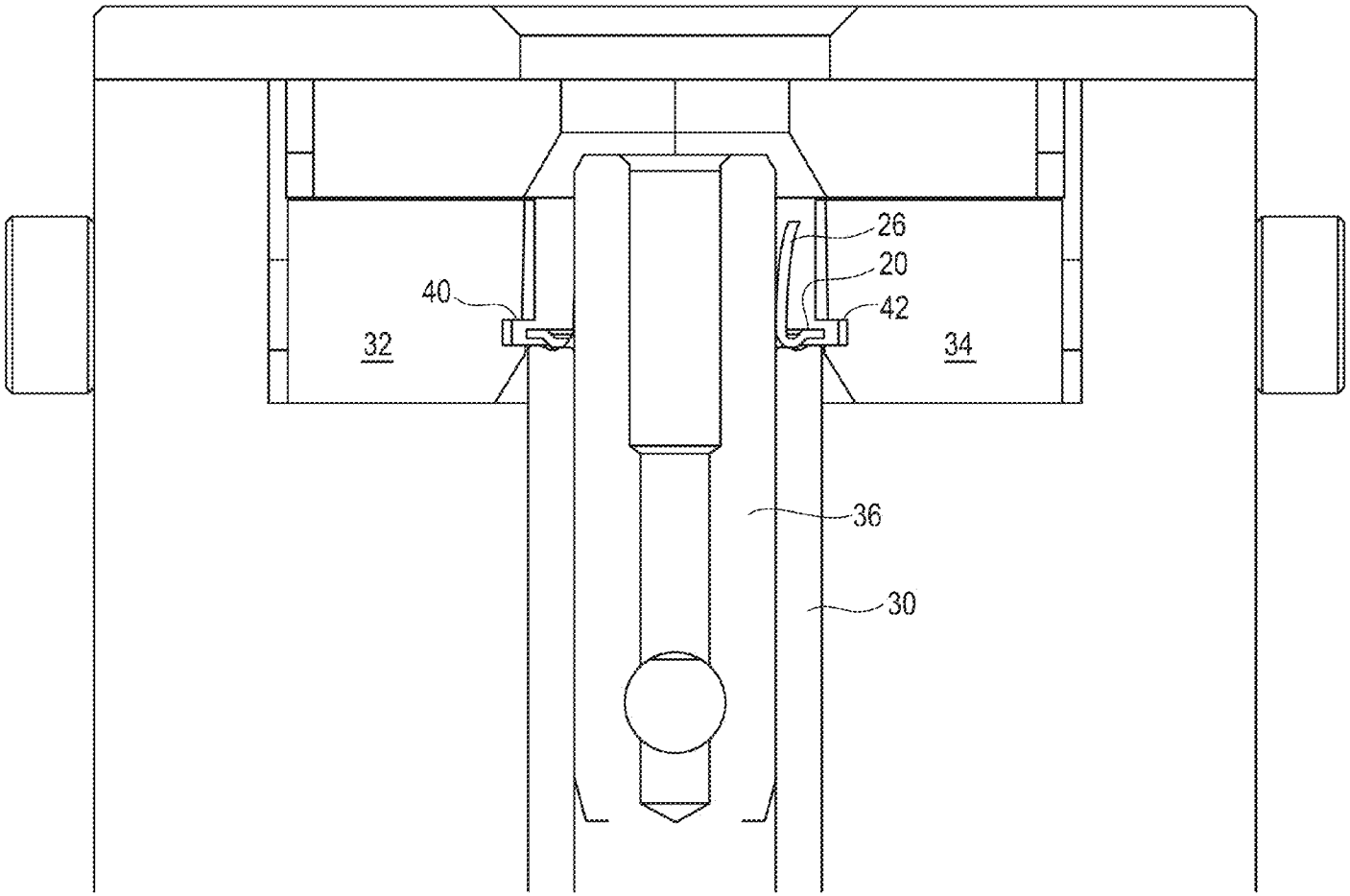

However, as shown in FIG. 5, as soon as the redirecting process is completed, abutting members 32, 34 are moved in substantially perpendicular directions away from the pin 36 in FIG. 5 in order to release ring 20 of prong ring 18, so that prong ring 18 can be freely moved, particularly in the upward direction. The releasing movement may be a linear movement of abutting members 32, 34 as shown in the drawings. However, the invention also covers solutions in which abutting members 32, 34 are moved relative to one another around a pivot point, like a pair of pliers. The abutting members 32, 34 are movable between at least two positions, a first position inhibiting a movement of the prong ring 18 toward the substrate 10, and a second position allowing the movement.

Figure 6:
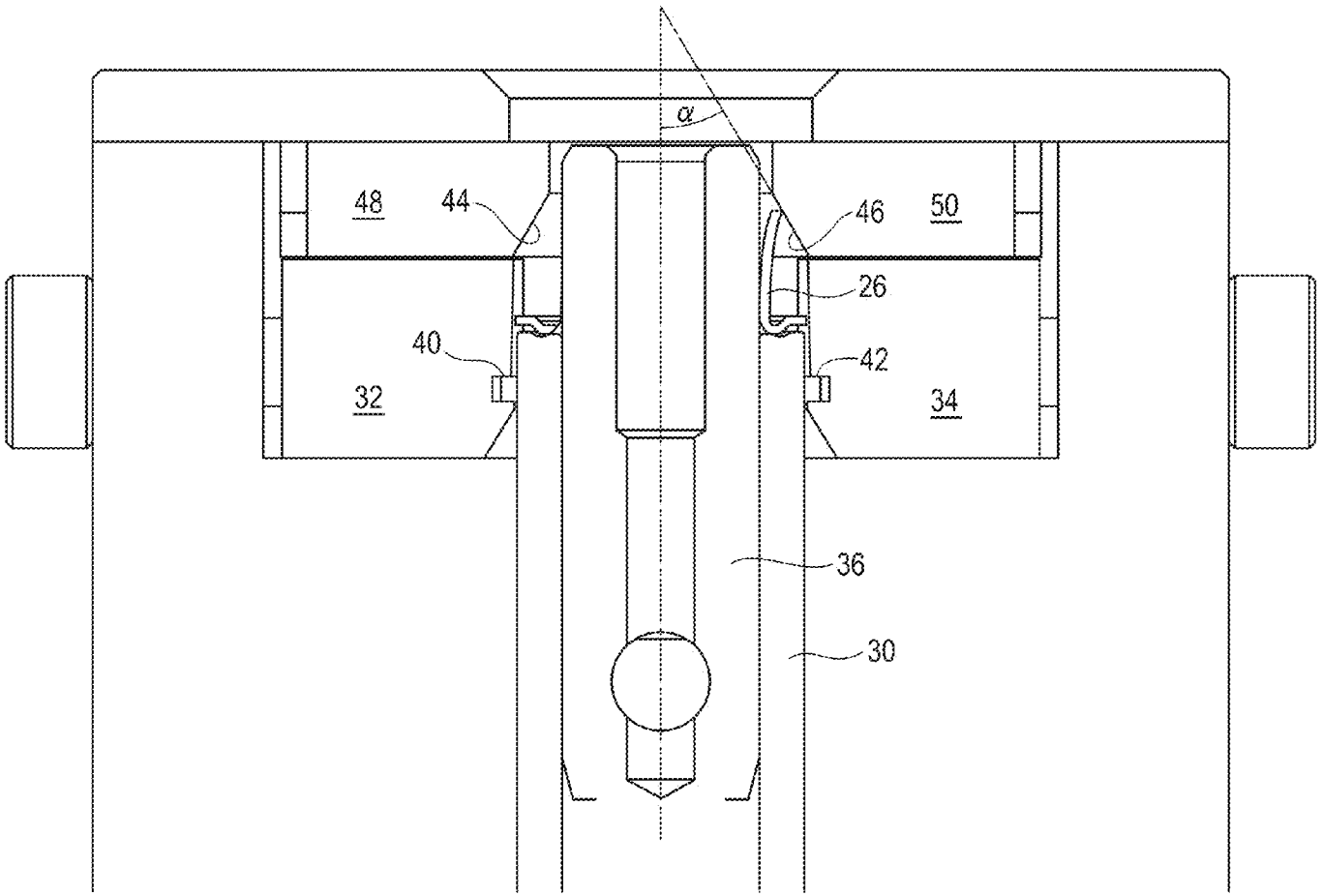

To this end, as shown in FIG. 6, in the next position lower die 30 is moved upwardly, resulting in that prong ring 18 is also moved so that it approaches substrate 10 (FIG. 1).

On their way upwards, prongs 22, 24 and 26, if bent outwardly abut sloped surfaces 44, 46 of redirecting members 48, 50, respectively. That is, the redirecting members 48, 50 are positioned in the path of the outwardly bent prongs 22, 24 and 26 when the prongs approach the substrate 10. In this embodiment, the sloped surfaces 44, 46 are sloped relative to the path of the prongs. As described later, in another embodiment, the sloped surfaces 44, 46 may be curved or have a radius.

In this embodiment, the redirecting member 48 having the sloped surface 44 is separated from the redirecting member 50 having the sloped surface 46. In another embodiment, the redirecting member 48 and the redirecting member 50 may be comprised of a single part and have only one sloped surface which includes the sloped surface 44 and the sloped surface 46. The redirecting member 48 and the redirecting member 50 may be comprised of three or more parts. In the case of one sloped surface, the sloped surface is a conical ring surface, and in the case of two or more sloped surfaces, the two or more sloped surfaces together make up a conical ring surface.

Figure 7:
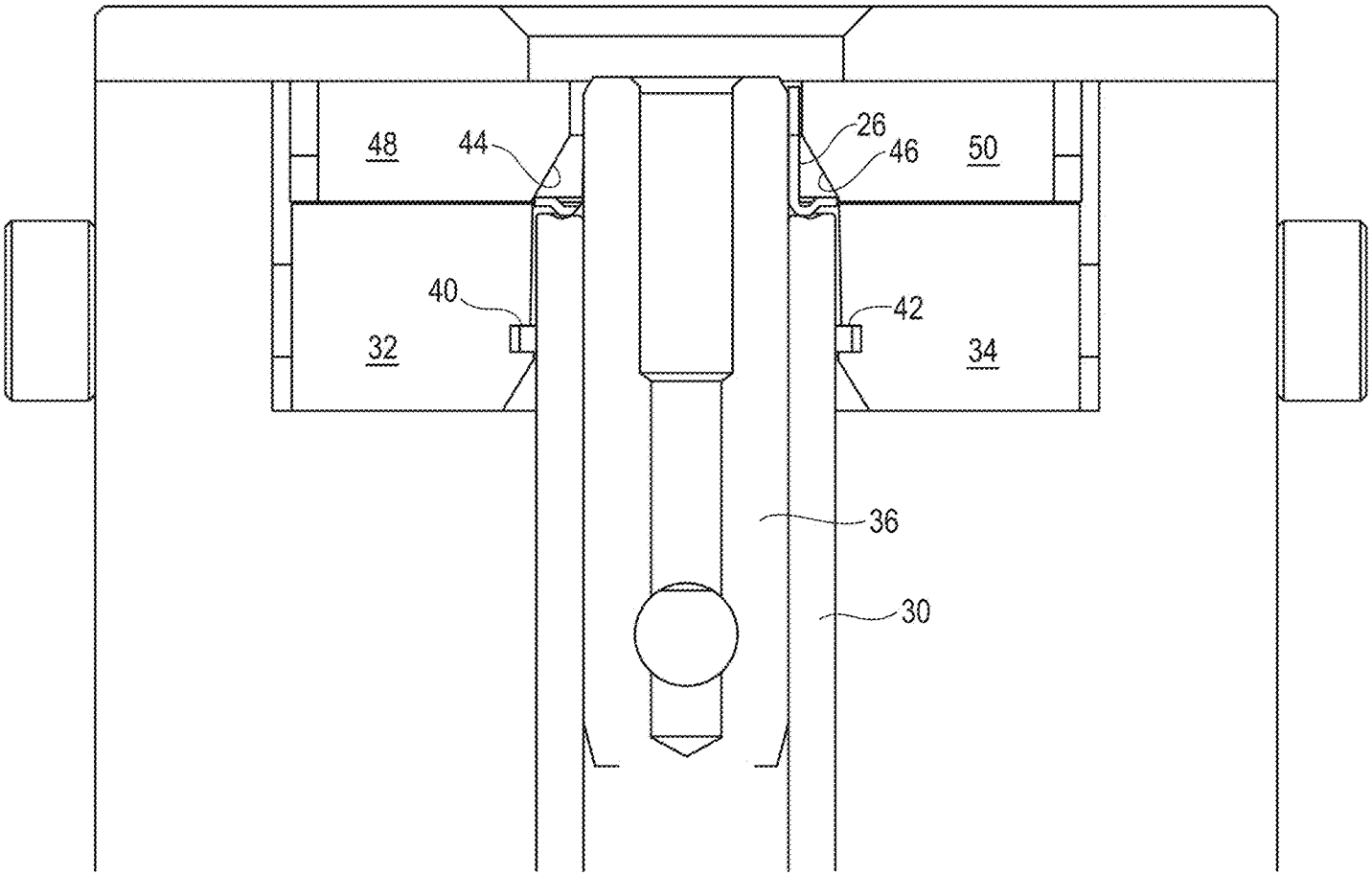

Further pushing of prong ring 18 by lower die 30 results in redirecting those prongs of prong ring 18 which are bent outwardly because they are guided along or driven by sloped surfaces 44, 46 and are completely redirected into the position, substantially parallel to the direction of movement of pin 36, as shown in FIG. 7.

Figure 8:
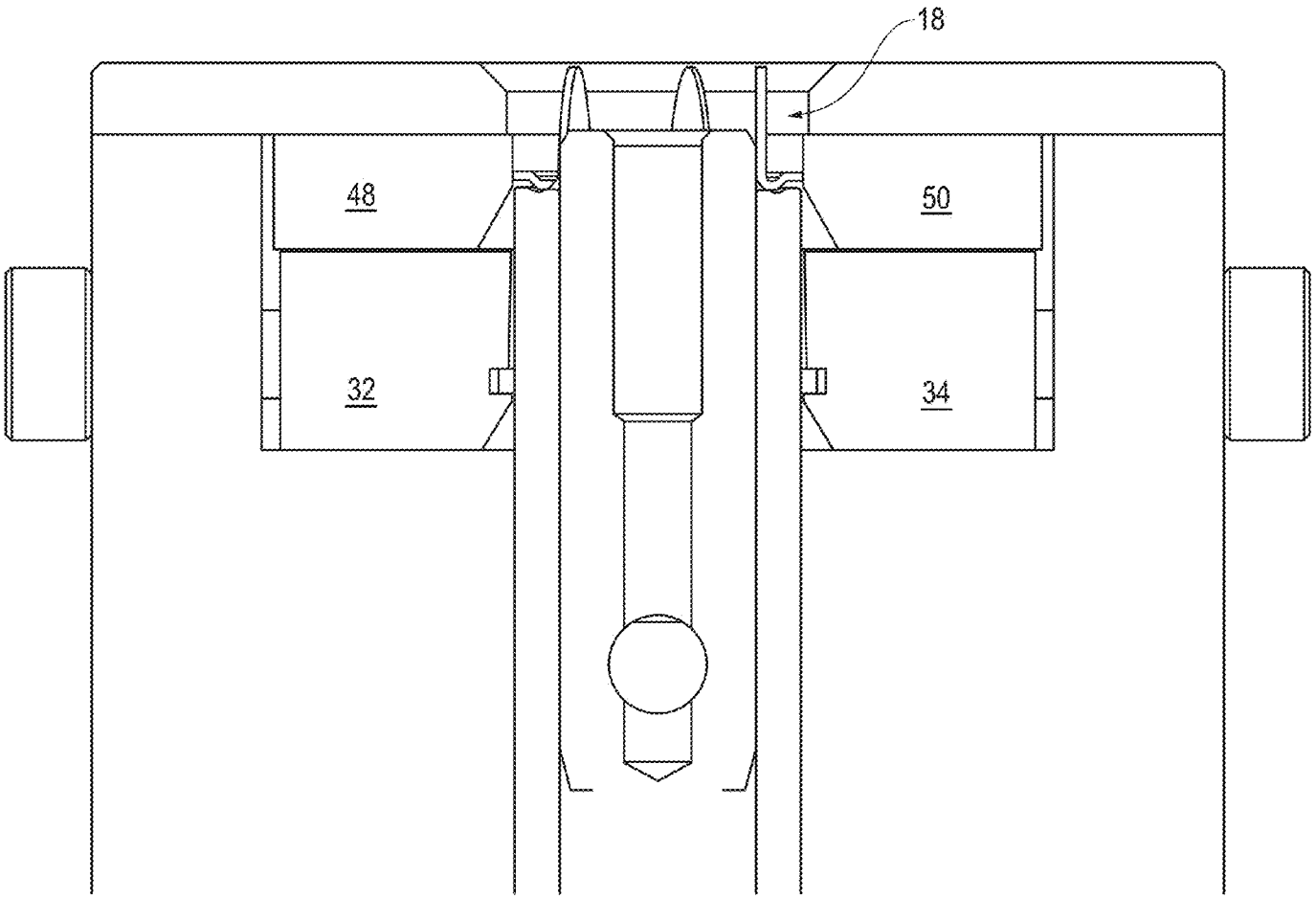
Figure 9:
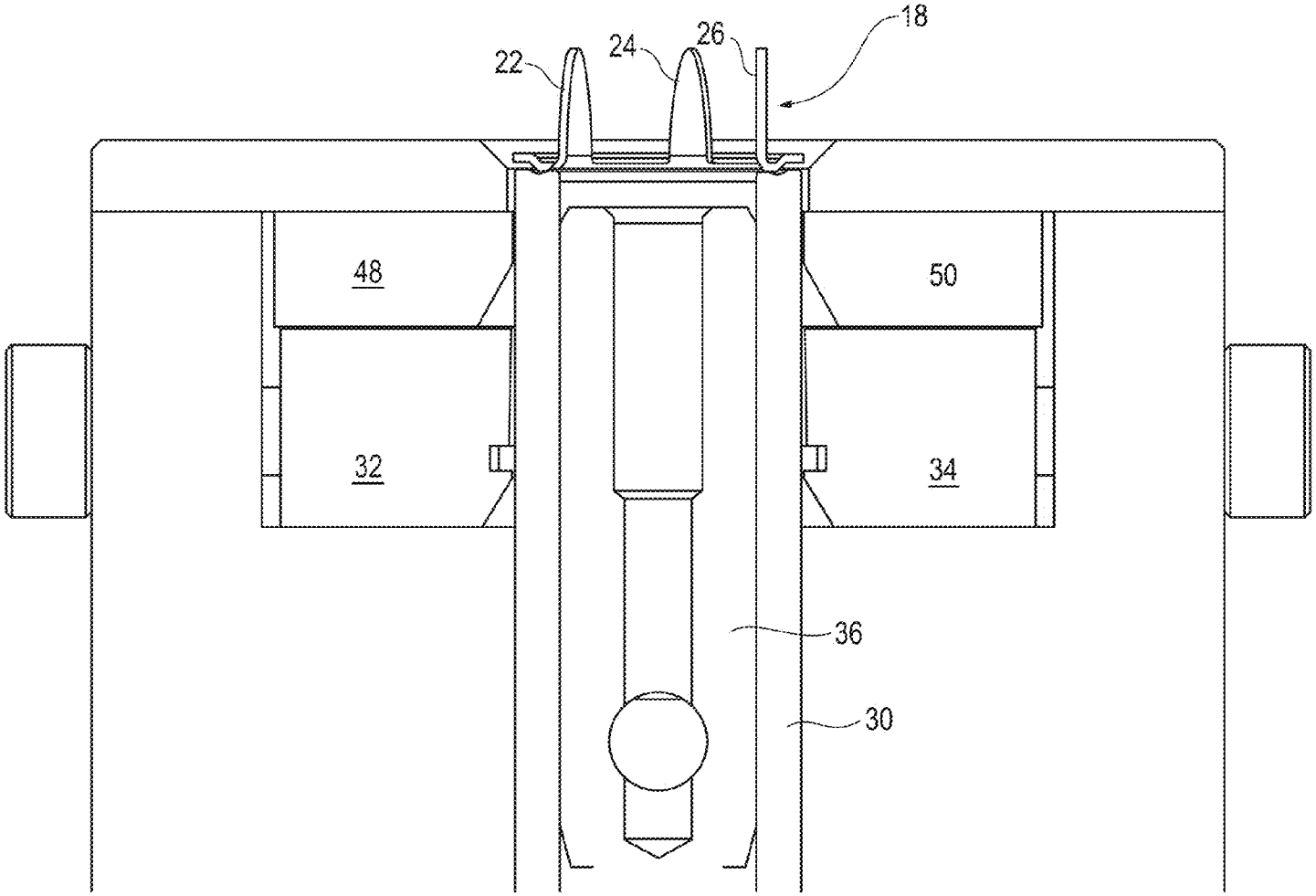

Thereafter, as shown in FIGS. 8 and 9, redirecting members 48, 50 are moved in substantially perpendicular directions away from the pin 36, whereupon after redirecting members 48 and 50 have been moved out of the path of the prong ring 18, preferably in a manner similar to that described regarding the movement of abutting members 32, 34 above, lower die 30 further pushes prong ring 18 in an upward manner.

As depicted in FIG. 9, thereafter, prong ring 18 is pushed by lower die 30 into a position in which prongs 22, 24 and 26 so as to extend through substrate 10 which is not shown in FIG. 9, but in FIG. 1. Simultaneously or thereafter, upper die 28 also not shown is lowered to initiate the attaching process as described above with reference to FIG. 1.

Figure 10:
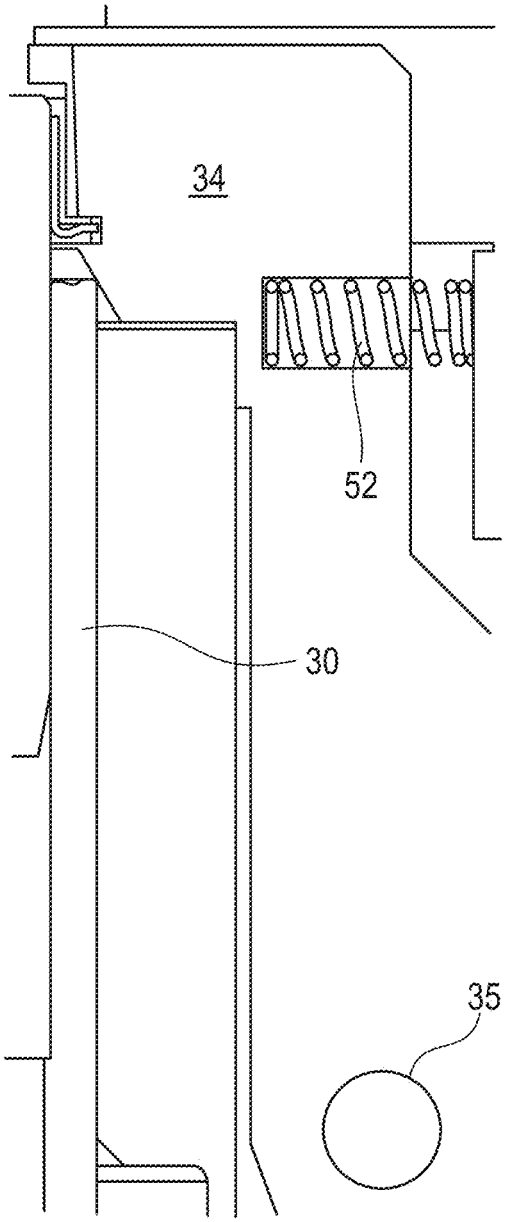

The abutting members 32, 34 may be biased into the first position. In this embodiment, as shown in FIG. 10, abutting member 34 is biased to move inwardly by spring 52. The same applies to other abutting member like abutting member 32. As a result, it is only necessary to move abutting members 32, 34 outwardly as shown in FIG. 4, whereas they automatically return into the position shown in FIG. 3 after the attaching process, due to the bias of spring 52.

With the embodiment shown in FIG. 10, abutting member 34 is not movable linearly but around a pivot point 35. Although not shown in the drawings, abutting member 32 can be arranged movably around a pivot point as well. The two pivot points can be the same or different from one another.

Like abutting members 32, 34, in a similar manner, redirecting members 48 and/or 50 can also be arranged not movable linearly, but around one or more pivot points.

Figure 11:
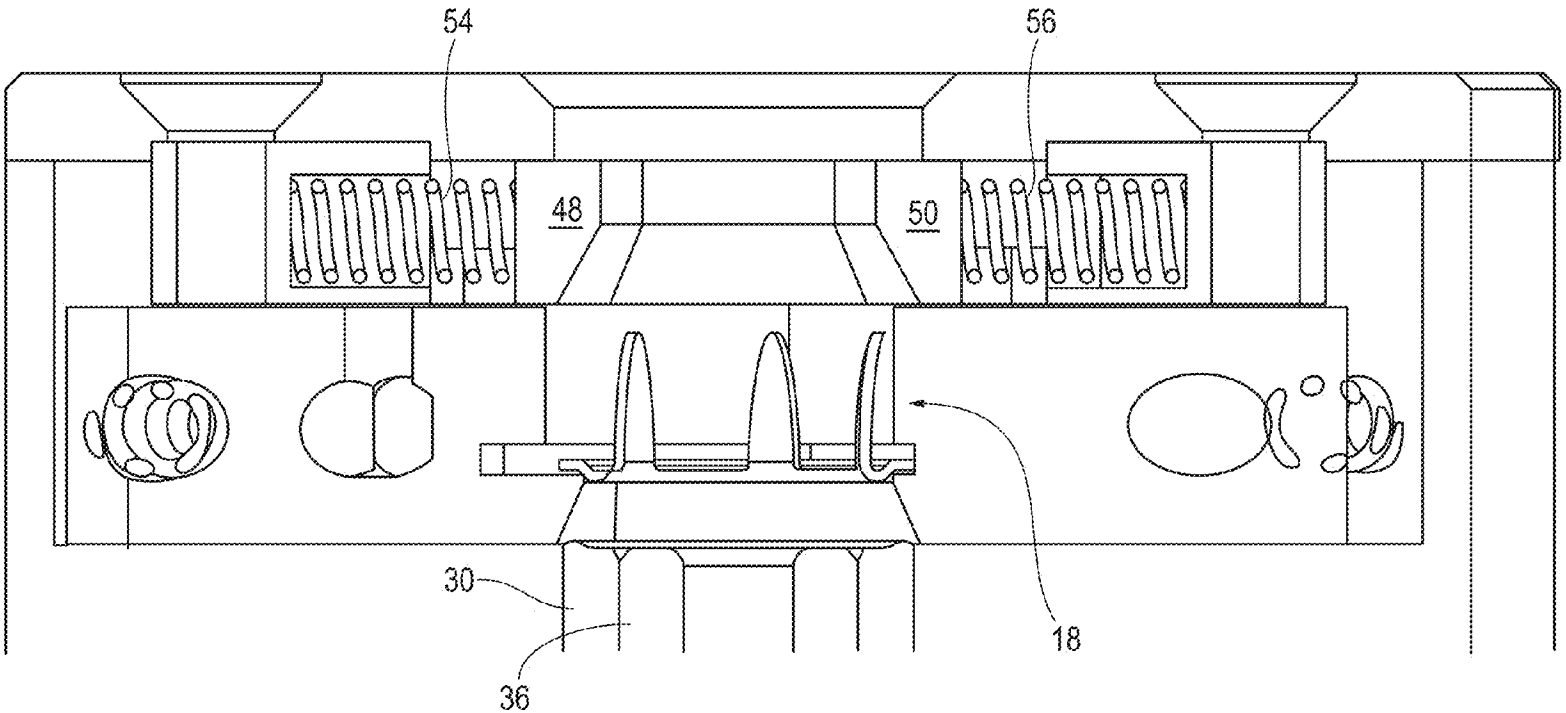

The same applies, mutatis mutandis, to redirecting members 48, 50 and possible other redirecting members with sloped surfaces. To this end, springs 54, 56 are provided as shown in FIG. 11. Once again, redirecting members 48, 50 are to be moved outwardly as in FIG. 8 so that prong ring 18 can be pushed upwardly, whereas they return into the position shown in FIG. 7 after the completion of the attaching process.

In the shown embodiment, abutting members 32, 34 as well as redirecting members 48, 50 automatically return into their initial position shown in FIG. 3 as soon as lower die 30 (and pin 36) is/are lowered because the bias resulting from springs 52, 54 and 56 moves the mentioned parts inwardly.

As already mentioned, the drawings are only schematically. The slope angle $\alpha$ of sloped surfaces 44, 46 is in the range of 10° to 60°, preferably 20° to 50°, more preferably 30° to 40°. In this embodiment, the slope angle $\alpha$ of sloped surfaces 44, 46 is 35°.

Figure 12:
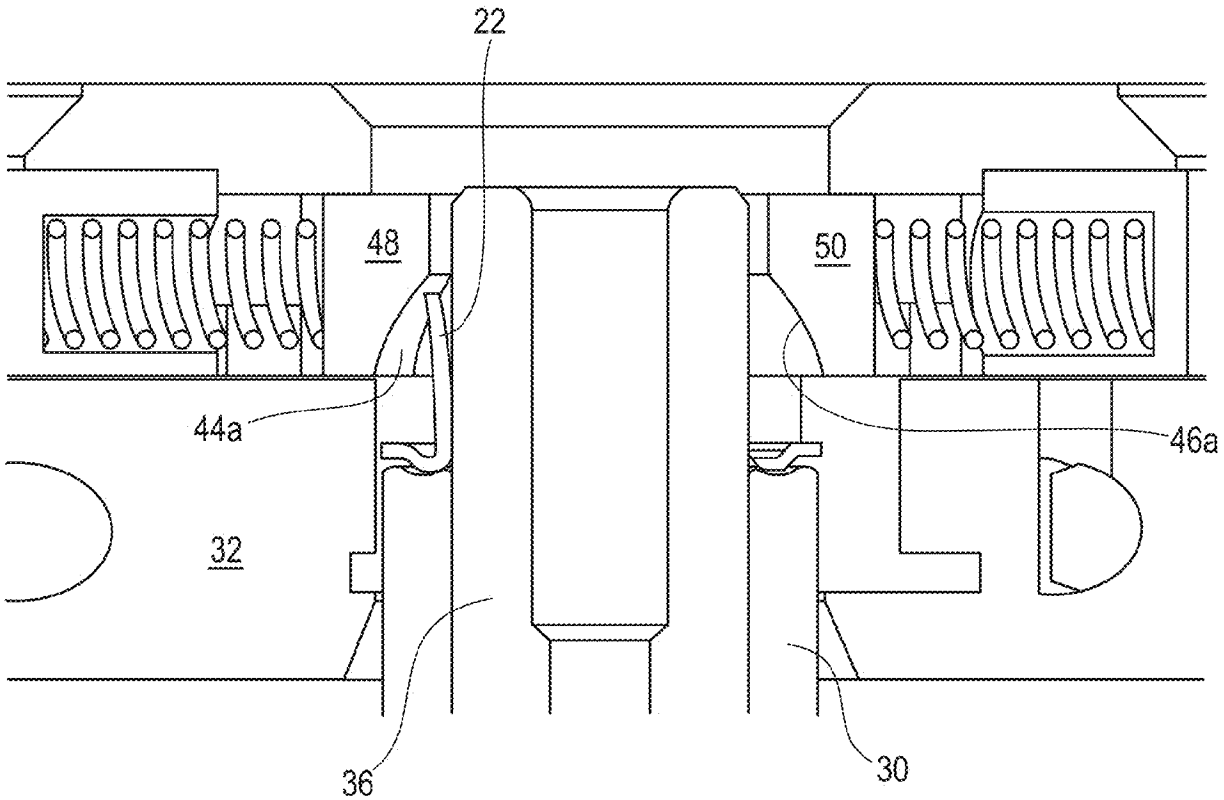

FIG. 12 shows the same operating status or positions as FIG. 6, but of another embodiment. Particularly sloped surfaces 44, 46 are replaced by (concave) curved surfaces 44*a*, 46*a* having a radius.

In this embodiment, the abutting member 32 is separated from the abutting member 34. In another embodiment, the abutting member 32 and the abutting member 34 may be comprised of a single part and may be comprised of three or more parts.

The characteristics of the invention disclosed in the above description, in the claims and in the drawings may be essential for the implementation of the invention in its various embodiments either alone or in any arbitrary combination with each other.

The invention claimed is:

1. An apparatus for attaching an item to one or more substrates, using a prong ring with a ring and two or more prongs, the prongs, when attached, extending from the ring on a first side of the substrate through such substrate and being bent, the apparatus comprising:

a lower die assembly; and an upper die positioned opposite the lower die assembly, wherein the lower die assembly includes a first redirecting member, a lower die, and an abutting member, wherein the first redirecting member is moveable within the lower die in an attaching direction towards the upper die, wherein the lower die is moveable within the lower die assembly in the attaching direction towards the upper die, wherein the substrate is placed between the lower die assembly and the upper die in a manner substantially perpendicular to the attaching direction, wherein a cross section of the first redirecting member perpendicular to the attaching direction is smaller than a center opening of the ring and is configured to redirect the prongs when the prongs are bent inwardly towards a center of the center opening of the ring, wherein the first redirecting member and the lower die are moveable through the abutting member, and the abutting member is provided with a holding member that inhibits a movement of the prong ring towards the upper die while the first redirecting member moves in the attaching direction towards the upper die.

2. The apparatus according to claim 1, wherein the first redirecting member is configured to be moved through the center opening of the ring of the prong ring past an upper surface of the abutting member.

3. The apparatus according to claim 1, wherein the first redirecting member is a pin having a circular cross section.

4. The apparatus according to claim 1, wherein the abutting member is movable between a first position and a second position in the lower die assembly, the abutting member inhibits the movement of the prong ring towards the substrate when in the first position, and allows the movement of the prong ring towards the substrate when in the second position.

5. The apparatus according to claim 4, wherein a biasing member configured to bias the abutting member into the first position is provided in the lower die assembly.

6. The apparatus according to claim 4, wherein the abutting member comprises at least two parts which are movable relative to one another, and each of the parts is movable between the first position and the second position by rotating around a pivot point.

7. The apparatus according to claim 1, comprising a second redirecting member configured to redirect the prongs when bent outwardly away from the center of the ring is provided in the lower die assembly, and the second redirecting member lies in a path of the outwardly bent prongs when the prong ring approaches the substrate.

8. The apparatus according to claim 7, wherein the second redirecting member comprises at least one surface that is sloped relative to the attaching direction or is curved or has a radius.

9. The apparatus according to claim 8, wherein the at least one surface of the second redirecting member is a sloped surface, and the sloped surface has a conical ring surface.

10. The apparatus according to claim 8, wherein the at least one surface is a sloped surface that is sloped relative to the attaching direction of the upper and lower dies by a slope angle which is in a range of 10° to 60°.

11. The apparatus according to claim 7, wherein at least part of the second redirecting member is movable in a direction transverse to the attaching direction of the upper and lower dies, and the at least part of the second redirecting member is biased toward the center of the ring.

12. The apparatus according to claim 8, wherein the second redirecting member includes two or more sloped surfaces, and the two or more sloped surfaces together make up a conical ring surface.

* * * * *